US011760959B2

(12) United States Patent
Sy

(10) Patent No.: US 11,760,959 B2
(45) Date of Patent: Sep. 19, 2023

(54) CLEANING PRODUCT

(71) Applicant: Nimble Babies Limited, Leamington Spa (GB)

(72) Inventor: Von Ryan Sy, Leamington Spa (GB)

(73) Assignee: NIMBLE BABIES LIMITED, Leamington Spa (GB)

( * ) Notice: Subject to any disclaimer, the term of this patent is extended or adjusted under 35 U.S.C. 154(b) by 32 days.

(21) Appl. No.: 17/588,768

(22) Filed: Jan. 31, 2022

(65) Prior Publication Data

US 2022/0154105 A1 May 19, 2022

Related U.S. Application Data

(62) Division of application No. 15/542,570, filed as application No. PCT/IB2016/050092 on Jan. 8, 2016, now abandoned.

(30) Foreign Application Priority Data

Jan. 9, 2015 (GB) ..... 1500340

(51) Int. Cl.

| | |
|---|---|
| ***C11D 1/94*** | (2006.01) |
| ***C11D 1/10*** | (2006.01) |
| ***C11D 1/90*** | (2006.01) |
| ***C11D 1/66*** | (2006.01) |
| ***C11D 3/20*** | (2006.01) |
| ***C11D 11/00*** | (2006.01) |
| ***C11D 17/04*** | (2006.01) |

(52) U.S. Cl.

CPC ..... *C11D 1/94* (2013.01); *C11D 1/10* (2013.01); *C11D 1/662* (2013.01); *C11D 1/90* (2013.01); *C11D 3/2079* (2013.01); *C11D 11/0035* (2013.01); *C11D 17/041* (2013.01)

(58) Field of Classification Search

None

See application file for complete search history.

(56) References Cited

U.S. PATENT DOCUMENTS

| | | | |
|---|---|---|---|
| 5,851,421 | A | 12/1998 | Choy |
| 6,528,047 | B2 | 3/2003 | Arif |
| 7,618,931 | B1 | 11/2009 | Scheuing |
| 2002/0115581 | A1 | 8/2002 | DuVal |
| 2003/0199402 | A1 | 10/2003 | Riplett et al. |
| 2005/0215449 | A1 | 9/2005 | Penninger |
| 2007/0049511 | A1 | 3/2007 | Lawshe |
| 2009/0092568 | A1 | 4/2009 | Mabrouk |
| 2012/0301421 | A1 | 11/2012 | Hecking |
| 2015/0203796 | A1 | 7/2015 | Miracle |

FOREIGN PATENT DOCUMENTS

| | | | | |
|---|---|---|---|---|
| CN | 102429833 | A | | 5/2012 |
| CN | 103173296 | A | * | 6/2013 |
| EP | 1250938 | A2 | | 10/2002 |
| WO | 2014/186831 | A1 | | 11/2014 |

OTHER PUBLICATIONS

International Search Report Issued from European Patent Office within the International Application No. PCT/B2016/050092 dated Mar. 5, 2016, 5 pages.
Final Office Action issued in the corresponding U.S. Appl. No. 15/542,570 dated Aug. 31, 2021, 15 pages.
Non Final Office Action issued in the corresponding U.S. Appl. No. 15/542,570 dated Feb. 8, 2021, 15 pages.
Final Office Action issued in the corresponding U.S. Appl. No. 15/542,570 dated Jun. 26, 2020, 13 pages.
Non Final Office Action issued in the corresponding U.S. Appl. No. 15/542,570 dated Jan. 8, 2020, 15 pages.
Final Office Action issued in the corresponding U.S. Appl. No. 15/542,570 dated Apr. 17, 2019, 7 pages.
Non Final Office Action issued in the corresponding U.S. Appl. No. 15/542,570 dated Dec. 18, 2018, 14 pages.
Requirement for Restriction Election in the corresponding U.S. Appl. No. 15/542,570 dated Sep. 28, 2018, 7 pages.

* cited by examiner

*Primary Examiner* — Tanisha Diggs
(74) *Attorney, Agent, or Firm* — Schott, P.C.

(57) ABSTRACT

The invention is a detergent solution for cleaning a receptacle for milk or liquid milk-derived products, the detergent solution comprising water, one or more types of surfactant and an odour absorbing compound. The surfactants are provided to dissolve greasy milk-based residues from the receptacle and the odour absorbing compound is provided to neutralise odours produced by any remaining milk-based residues not removed by the surfactants. The detergent solution is water-based so that it can be rinsed off easily in a sink in the home. The detergent solution is particularly suited to plastic receptacles because plastic is more prone to accumulating mal-odour producing bacteria. This is because a plastic surface is more porous than glass so it is more difficult to remove greasy residues from a plastic surface and therefore grease can build up in the pores, out of the reach of surfactants, and provide a place for odour-producing bacteria to grow. An odour absorbing compound does not remove the residue but can neutralise the odours from the residue. The invention also discloses a method for dispensing a detergent solution comprising at least one surfactant, the method comprising ejecting detergent solution from a reservoir in the form of a spray, wherein the surfactant is present in the detergent solution in an amount of from 3% to 15% by weight of the detergent solution. The invention discloses also a method of cleaning a receptacle for milk, or liquid milk-derived products, the method comprising: spraying a detergent solution comprising at least one surfactant onto the receptacle, wherein the surfactant is present in the detergent solution in an amount of from 3% to 15% by weight of the detergent solution.

13 Claims, 1 Drawing Sheet

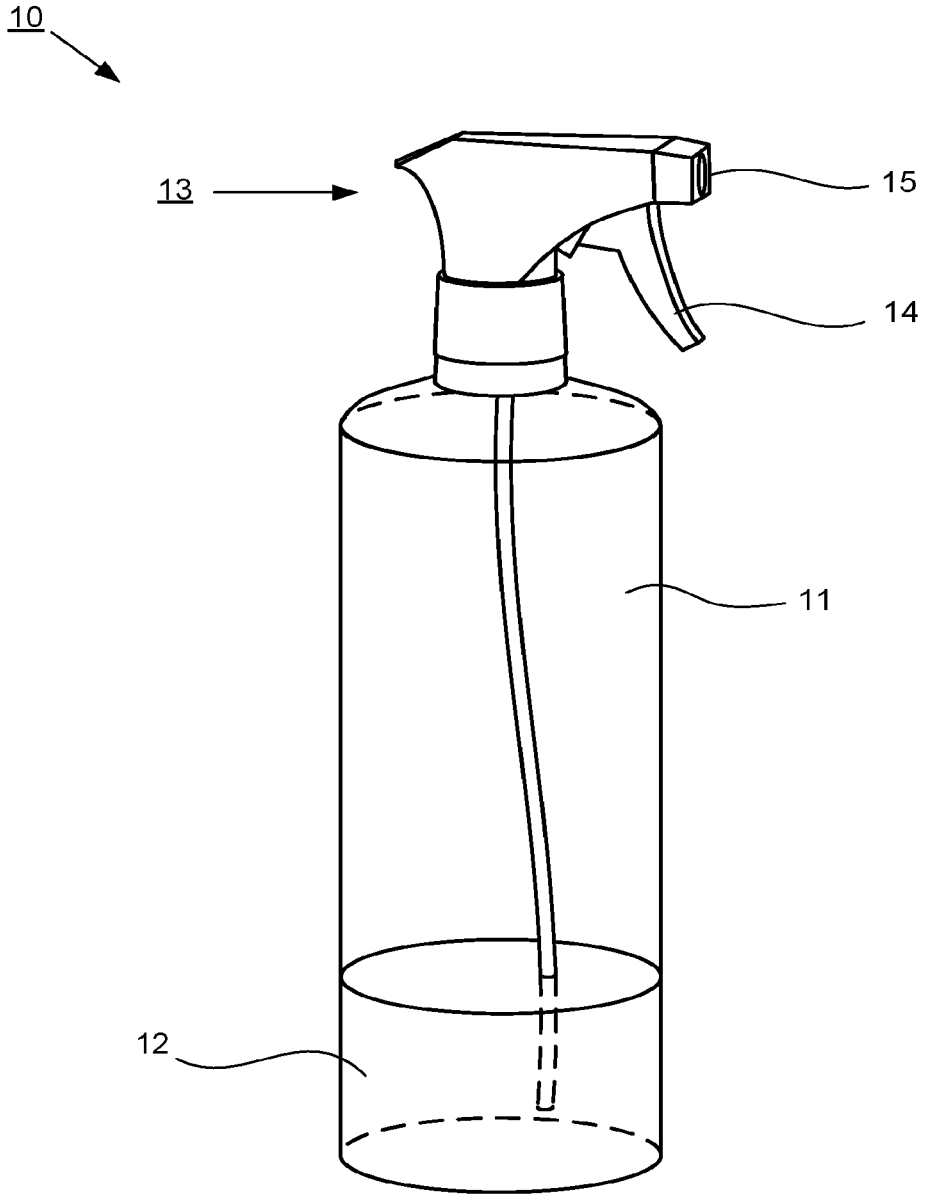
10
13
15
14
11
12

CLEANING PRODUCT

The present invention relates to products and methods for cleaning. In particular, the present invention relates to methods for cleaning receptacles for milk or liquid milk-derived products.

It is notoriously difficult to effectively clean receptacles that have been used to hold milk or liquid milk-derived products. The term liquid milk-derived products may refer to liquids containing milk-derived products, milk-derived products being products such as whey, whey protein, casein and/or fats derived from milk. Examples of liquid milk-derived products include milk formulas for babies or protein supplements. It is often difficult to completely remove milk or liquid milk-derived products from a receptacle due to a high fat content of some of these liquids. Also, such liquids often leave behind an unpleasant odour if they are not removed in a short amount of time. These issues are particularly problematic for plastic receptacles e.g. baby bottles or protein shakers.

Antibacterial sprays often used for cleaning surfaces and other objects are not suitable for cleaning receptacles for milk or liquid milk-derived products, e.g. baby bottles, because the active ingredients therein may be harmful if ingested and they may leave behind an unpleasant bleach smell. Conventional washing-up liquids are heavily perfumed to mask odours and also contain harmful ingredients.

It is an aim of the present invention to at least partially address at least some of the problems discussed above.

According to a first aspect of the invention a detergent solution is provided for cleaning a receptacle for milk or liquid milk-derived products, the detergent solution comprising water, one or more types of surfactant and an odour absorbing compound. The surfactants are provided to dissolve greasy milk-based residues from the receptacle and the odour absorbing compound is provided to neutralise odours produced by any remaining milk-based residues not removed by the surfactants. The detergent solution is water-based so that it can be rinsed off easily in a sink in the home. The detergent solution is particularly suited to plastic receptacles because plastic is more prone to accumulating odour producing bacteria. A plastic surface is more porous than glass so it is more difficult to completely remove greasy residues from a plastic surface. Grease can build up in the pores, out of the reach of surfactants, and provide a place for odour-producing bacteria to grow. An odour absorbing compound does not remove the residue but can neutralise the odours produced by the bacteria that live on the residues.

It is preferable to use plant-based surfactants because these are not toxic, which is important for this application. Particularly suitable surfactants are sugar-based. A surfactant may be an alkyl polyglucoside (APG), particularly C10-16 Alkyl Polyglucoside. A further advantage of using APG is that this group of surfactants are plastic-friendly and do not cause cracking or stress the plastic.

The one or more surfactants can further include Sodium Lauroyl Sarcosinate to boost foam and/or Cocamidopropyl Betaine which gives the detergent solution a gentle feel to the touch.

The odour absorbing compound may be Zinc Diricinoleate which is non-toxic and chemically bonds to odour-producing compounds to neutralise them.

The total concentration of one or more of the surfactants may be from 3% to 15% by weight of the detergent solution to provide sufficient quantity of surfactant to tackle the greasy residues inside and around the rim of the receptacle.

The concentration of the odour absorbing compound may be 0.01%-2% by weight of the detergent solution, which is sufficient to neutralise the remaining odours produced by bacteria on the greasy milk-based substances if not removed by the surfactants. Preferably the concentration of the odour absorbing compound is 0.5% to 1.5% by weight and still more preferably a concentration of 1%. It is preferable to have a low concentration of odour absorbing compound in the detergent solution, i.e. 2% or below, preferably around 1% because the odour absorbing compound can be more easily dissolved and dispersed in the detergent solution. This means that more of the odour absorbing compound will be readily available in the solution to act on malodour compounds. Zinc Diricinoleate itself is insoluble in water, and it is solubilised by the surfactants in the detergent solution; it follows that less odour absorbing compound leaves more surfactant available for grease removal purposes. For this application, i.e. cleaning plastic bottles and absorbing the odour of non-removed soil, the ratio of surfactants to odour absorbing compound is important; the amount of cleaning surfactant is maximized for cleaning and the amount of odour absorbing compound is minimised to an amount just sufficient to neutralise odours caused by greasy residues that have not been removed from the surface of the plastic bottle by cleaning.

The detergent solution may have a viscosity less than 1 mPa·s at a temperature of 25° C. and may be suitable for dispensing in the form of a spray. The detergent solution may be provided in a ready-to-use formulation so does not need to be diluted before use and is therefore more convenient to use. The detergent solution may be 80-97% water.

According to a second aspect, an apparatus for dispensing a detergent solution is provided comprising at least one surfactant, the apparatus comprising a reservoir, containing the detergent solution; and a spray unit configured to eject the detergent solution from the reservoir in the form of a spray. Spraying the detergent solution onto the receptacle ensures that the solution is evenly distributed.

According to a third aspect, a method for dispensing the detergent solution is provided, the method comprising ejecting detergent solution from a reservoir in the form of a spray.

According to a fourth aspect, a method of cleaning a receptacle for milk, or liquid milk-derived products is provided, the method comprising spraying a detergent solution comprising at least one surfactant onto the receptacle.

According to another aspect of the invention there is provided a method for dispensing a detergent solution comprising at least one surfactant, the method comprising ejecting detergent solution from a reservoir in the form of a spray, wherein the surfactant is present in the detergent solution in an amount of from 3% to 15% by weight of the detergent solution.

According to a further aspect of the invention there is provided an apparatus for dispensing a detergent solution comprising at least one surfactant, the apparatus comprising:

a reservoir, containing the detergent solution; and a spray unit configured to eject the detergent solution from the reservoir in the form of a spray, wherein the surfactant is present in the detergent solution in an amount of from 3% to 15% by weight of the detergent solution.

According to a further aspect of the invention there is provided a method of cleaning a receptacle for milk, or liquid milk-derived products, the method comprising: spraying a detergent solution comprising at least one surfactant onto the receptacle, wherein the surfactant is present in the detergent solution in an amount of from 3% to 15% by weight of the detergent solution.

Optionally, the detergent solution may have a viscosity of less than 1 mPa·s at a temperature of 25° C.

Optionally, the at least one surfactant may include C10-16-Alkyl Polyglucoside,

Sodium Lauroyl Sarcosinate and Cocamidopropyl Betaine.

Optionally, the detergent solution may further comprise an odour absorbing compound.

Optionally, the odour absorbing compound may be Zinc Diricinoleate. According to a fourth aspect of the invention there is provided a detergent solution, for cleaning a receptacle for milk or liquid milk-derived products, comprising one or more surfactants and an odour absorbing compound.

Optionally, the one or more surfactants may include C10-16 Alkyl Polyglucoside, Sodium Lauroyl Sarcosinate and Cocamidopropyl Betaine.

Optionally, the odour absorbing compound may be Zinc Diricinoleate.

Optionally, the one or more surfactants may be present in an amount of from 3% to 15% by weight of the detergent solution.

Optionally, the detergent solution may have a viscosity less than 1 mPa·s at a temperature of 25° C.

Optionally, the detergent solution may be suitable for dispensing in the form of a spray. The invention will be described below by way of example and with reference to the accompanying drawings in which:

FIG. 1 shows an apparatus for dispensing detergent solution according to the present invention.

Plastic bottles for milk or protein drinks can be difficult to clean. Often, a user will experience a sour odour from a plastic baby bottle or protein shaker, even after it has been washed thoroughly with conventional washing-up liquid. The user may even be tempted to use undiluted washing-up liquid on the bottle to remove the smell, but this only leaves the strong perfume odour of the washing-up liquid and can also leave harmful residues of the strong detergents of the washing-up liquid. The persistent odour experienced by the user is particularly acute for plastic bottles because of the surface structure of plastic. Plastics, such as polycarbonate, polyethylene and polypropylene have a rough structured surface on a microscopic scale, with pores, recesses and other defects. Oily and greasy residues can remain in these pores out of reach of detergents and therefore provide a breeding ground for odour-producing bacteria even after cleaning. Furthermore, many of the surfactants commonly used in washing-up liquid detergents cause stress in plastics, leading to cracks and clouding of the surface of the receptacle, and its general degradation.

In an embodiment of the invention, a water-based detergent solution is provided that includes surfactants for tackling and dissolving the greasy compounds previously stored in the receptacle and an odour absorbing compound. The odour absorbing compound may be a zinc containing odour absorbing compound, for example Zinc Diricinoleate. Conventional detergents used for washing baby bottles often contain perfumes or fragrances for masking foul odours. The odour absorbing compound of the present invention removes odours, such as the spoilt smell of milk, as opposed to simply masking them, thus providing superior cleaning compared to conventional cleaning methods. Zinc Diricinoleate chemically reacts with the odour-producing organic substances to neutralise the odours. Only a low concentration of odour absorber is required to be effective and preferably a concentration of Zinc Diricinoleate of between 0.01% to 2% is used, most preferably 1%.

The surfactants used in the detergent solution may include C10-16-Alkyl Polyglucoside (the Alkyl portion having 10 to 16 carbon atoms), Sodium Lauroyl Sarcosinate and/or Cocamidopropyl Betaine. These surfactants are chosen for their mildness and non-toxicity which are important for cleaning baby bottles. These surfactants are also chosen for their excellent soil removal, particularly for oily or fatty soil which milk may be rich in. The surfactants are also chosen because they generate sufficient foam in use to provide the required sensory and visual cues to the user that the detergent solution is working and/or the generated foam collapses easily to allow the detergent to be removed during a rinsing stage of the cleaning method. C10-16-Alkyl Polyglucoside in particular is also chosen for its excellent compatibility with plastic materials, for example it may reduce cracking and plastic stress.

The surfactants used in the detergent solution of the present invention may be present in the detergent solution in an amount of from 3% to 15% by weight of the detergent solution. Preferably, each of the surfactants may be present in an amount as follows:

C10-16-Alkyl Polyglucoside 3%-15%

Sodium Lauroyl Sarcosinate 0%-12%

Cocamidopropyl Betaine 0%-12%

Zinc Diricinoleate is insoluble in water and is solubilized by surfactants. It is preferable to have a concentration of Zinc Diricinoleate in the detergent solution of 2% or below, preferably around 1% because this maximizes the surfactant available for removing greasy residues from the receptacle while providing enough Zinc Diricinoleate to neutralise malodour compounds. Furthermore, at a Zinc Diricinoleate concentration of 2% or below, the compound can be fully dissolved and dispersed in the detergent solution, so that it is readily available in the solution to act on malodour compounds. For this application, i.e. cleaning plastic bottles and absorbing the odour of non-removed soil, the ratio of surfactants to odour absorbing compound is important; the amount of cleaning surfactant is maximized for cleaning and the amount of odour absorbing compound is minimised to an amount just sufficient to neutralise odours caused by greasy residues that have not been removed from the surface of the plastic bottle by cleaning.

The present invention provides a method for dispensing a detergent solution comprising at least one surfactant, the method comprising ejecting the detergent solution from a reservoir in the form of a spray. FIG. 1 shows an example of an apparatus 10 for dispensing the detergent solution which comprises a reservoir 11 containing the detergent solution 12 and a spray unit 13 configured to eject the detergent solution from the reservoir 11 in the form of a spray. The spray may comprise droplets of the detergent solution dispersed in air.

The spray may be formed by a user actuating a trigger 14 forming part of the spray unit 13. Actuation of the trigger 14 may create a pressure gradient drawing detergent solution from the reservoir 11 and ejecting the detergent solution through a nozzle 15 to form a spray.

Alternatively, the spray may be formed by actuating a valve of an aerosol forming part of the spray unit. Actuating the valve may result in ejection of the detergent solution from the reservoir, along with a propellant, in the form of a spray.

The present invention also provides a method for cleaning a receptacle for milk or liquid milk-derived products, the method comprises spraying the detergent solution onto the receptacle. The method may further comprise one or more of the steps of: applying water to the receptacle prior to spraying the detergent solution; scrubbing the receptacle after spraying the detergent solution to mix the detergent solution with any soil on the receptacle; and rinsing the receptacle after scrubbing to remove the detergent solution and the soil. The above steps may be repeated as necessary.

The term milk may refer to any milk produced naturally by mammals including for example, human breast milk, cow's milk, goat's milk or sheep's milk. The milk may be processed, for example to reduce some of the fat content (e.g. semi skimmed or skimmed cows milk) and/or to sterilise the milk (e.g. by pasteurisation). The term milk may also refer to plant-based milk substitutes including for example, soy milk or almond milk. Most generally the term milk may refer to a stable emulsion of fat, water and protein. The term liquid milk-derived products may refer to liquids containing milk-derived products, milk-derived products being products such as whey, whey protein, casein and/or fats derived from milk. In particular the term liquids containing milk-derived products may refer to milk formulas for babies or protein supplements for athletes. A receptacle for milk or liquids containing milk-derived products may refer to a bottle for feeding babies (baby bottles) or bottles or cups for mixing protein drinks by shaking (protein shakers).

In the following paragraphs the invention will be described in relation to baby bottles and milk, however it will be appreciated that the same applies to any receptacle for milk or liquids containing milk-derived products.

A conventional method of cleaning baby bottles is to dispense a detergent from a squeezable bottle into a basin of water thus making up a dilute detergent solution. The receptacle is then cleaned in the dilute detergent solution. The receptacle may also be sterilised by for example submerging the bottle in boiling water. The present invention provides superior cleaning to this conventional cleaning method by dispensing a detergent solution in the form of a spray.

The superior cleaning performance of the present invention comes in part from the fact that the detergent solution is pre-prepared for use. This prevents over dilution of the detergent solution. Further this ensures that the detergent is dispersed relatively evenly in the solution compared to the conventional cleaning method, thus improving the reliability of the cleaning method.

The superior cleaning performance of the present invention also comes in part from the fact that the detergent solution is dispensed in the form of a spray. This ensures that the baby bottle is relatively evenly covered by the detergent solution, thus improving the reliability of the cleaning method relative to the conventional method. Further, specific areas of the baby bottle may be targeted by the spray, e.g. the teat of a baby's bottle, thus improving the cleaning of hard to reach or heavily soiled parts of the baby bottle.

The surfactant concentration of a conventional detergent or dishwashing liquid is around 30% by weight. A dilute detergent solution as used in the conventional cleaning method above typically contains around 2.5 grams of detergent per litre of water so around 0.75 grams of surfactant per litre. By applying the detergent solution of the present invention directly to a baby bottle to be cleaned, which has already had water applied to it, it is possible to achieve a dilute detergent solution containing around 100 grams of the detergent solution per litre of water which may equate to around a ten-fold increase in concentration of surfactant using the cleaning method of the present invention, compared to the conventional cleaning method. This significant difference in surfactant concentration between the cleaning method of the present invention and the conventional method results in superior cleaning using the method of the present invention.

If conventional detergent products or dishwashing liquid products are applied directly to the baby bottle without dilution, perfumes or fragrances from these products may be overpowering. These overpowering fragrances can be difficult to remove.

The detergent solution of the present invention may be water thin. The detergent solution may have a dynamic viscosity of less than 1 mPa·s at 25 degrees centigrade as measured by conventional methods. The detergent may have substantially the same viscosity as water, namely 1 mPa·s at 20 degrees centigrade. The viscosity of the detergent solution may determine certain characteristics of the spray, for example the size of droplets in the spray, a solid angle of the spray and the speed of droplets ejected in the spray.

The detergent solution may also include pH buffers, such as Citric Acid, sequestrants, such as Sodium Gluconate, and/or preservatives such as 2-Bromo-2-Nitro-Propane-1,3-Diol.

An example of a detergent solution according to the present invention may include the following ingredients: Aqua (water), APG, Sodium Lauroyl Sarcosinate, Zinc Diricinoleate, Cocamidopropyl Betaine, Citric Acid, Sodium Gluconate and 2-Bromo-2-Nitro-Propane-1,3-Diol. These ingredients may be present in the amounts shown in Table 1. The first column of Table 1 indicates the trade name for products used in the detergent solution; the second column of Table 1 indicates the active ingredient contained in that trade name product; the third column of Table 1 indicates the percentage of active ingredient by weight in the trade name product; the fourth column of Table 1 indicates the percentage of active ingredient by weight in the detergent solution if the active ingredient only was used to formulate the detergent solution; the fifth column of Table 1 indicates the percentage of trade name product by weight in the detergent solution, i.e. the required percentage of trade name product to achieve the desired percentage of active ingredient (with the exception of water).

TABLE 1

| Product trade name | Active ingredient | % of active ingredient in trade name product | % active ingredient in detergent solution | % product in detergent solution |
|---|---|---|---|---|
| Reversed osmosis water (Merseyside) | Aqua (water) | 100 | 93.81 | 82.59 |
| Simulsol SL55 | C10-16-Alkyl Polyglucoside | 55 | 3.00 | 5.45 |
| Surfacare L30 | Sodium Lauroyl Sarcosinate | 30 | 1.50 | 5.00 |
| Surfac B4 | Cocamidopropyl Betaine | 30 | 0.50 | 1.67 |
| Surfac Sodium Gluconate | Sodium Gluconate | 50 | 0.10 | 0.20 |
| Bronopol BP (powder) | 2-Bromo-2-Nitro-Propane-1,3,-Diol | 100 | 0.09 | 0.09 |

TABLE 1-continued

| Product trade name | Active ingredient | % of active ingredient in trade name product | % active ingredient in detergent solution | % product in detergent solution |
|---|---|---|---|---|
| Polyfix Osorb | Zinc Diricinoleate | 20 | 1.00 | 5.00 |
| Surfac Citric Acid Mono BP | Citric Acid | 100 | <1.00 | <1.00 |

I claim:

1. A method for cleaning baby bottles that deliver milk or liquid milk-derived products comprising:

providing a spray bottle;

providing a detergent solution in the form of a spray comprising:

water;

surfactants; and an odor absorbing compound, wherein the total concentration of the surfactants is from 0.3% to 6.5% by weight of the detergent solution, and wherein the odour absorbing compound is Zinc Diricinoleate in a concentration of 0.01%-2% by weight of the detergent solution, and wherein the surfactants are C10-16 Alkyl Polyglucoside in a concentration of 0.1% to 3.5% by weight of the detergent solution, Sodium Lauroyl Sarcosinate in a concentration of 0.1% to 2% by weight of the detergent solution, and Cocamidopropyl Betaine in a concentration of 0.1% to 1% by weight of the detergent solution, and wherein the detergent solution has a viscosity of less than 1 mPa·s at a temperature of 25° C;

dispensing the detergent solution from the spray bottle by spraying it onto and the detergent solution into the baby bottles and washing the baby bottles using the detergent solution.

2. The method of claim 1, wherein the concentration of the odor absorbing compound is 0.5% to 1.5% by weight of the detergent solution.

3. The method of claim 1, wherein the detergent solution is suitable for dispensing in the form of a spray.

4. The method of claim 1, wherein the detergent solution comprises 80-90% water.

5. The method of claim 1, wherein the detergent solution is a ready-to-use formulation.

6. The method of claim 1, wherein the spray bottle comprises:

a reservoir, containing the detergent solution; and a spray unit configured to eject the detergent solution from the reservoir in the form of the spray.

7. The method of claim 1, wherein the Cocamidopropyl Betaine is in a concentration of 0.1% to 0.5% by weight of the detergent solution.

8. The method of claim 1, wherein the viscosity of the detergent solution is the same as the viscosity of water.

9. The method of claim 1, wherein the viscosity of the detergent solution is 1 mPa·s at a temperature of 20° C.

10. The method of claim 1, wherein the detergent solutions further comprises one or more sequestrants.

11. The method of claim 10, wherein the one or more sequestrants comprises sodium gluconate.

12. The method of claim 1, wherein the detergent solutions comprises one or more preservatives.

13. The method of claim 12, wherein the one or more preservatives comprises 2-bromo-2-nitropropane-1,3-diol.

* * * * *